US006435163B1

(12) United States Patent
Fauser et al.

(10) Patent No.: US 6,435,163 B1
(45) Date of Patent: Aug. 20, 2002

(54) FUEL SUPPLY DEVICE

(75) Inventors: Edwin Fauser, Ditzingen; Stephan Kleppner, Bretten; Kurt Frank, Schorndorf; Hans-Peter Braun, Renfrizhausen; Wolfgang Bueser, Freiberg; Klaus-Dieter Hufnagel, Moeglingen; Willi Strohl, Beilstein; Jochen Rose, Hemmingen; Wolfgang Hiller, Bietigheim-Bissingen; Erich Eiler, Sersheim, all of (DE); Frantisek Buric; Jaroslav Moucka, both of Ceske Budejovice (CZ)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/381,576

(22) PCT Filed: Jan. 9, 1998

(86) PCT No.: PCT/DE98/00056

§ 371 (c)(1),
(2), (4) Date: Mar. 1, 2000

(87) PCT Pub. No.: WO98/42973

PCT Pub. Date: Oct. 1, 1998

(30) Foreign Application Priority Data

Mar. 22, 1997 (DE) ..... 197 12 155

(51) Int. Cl.[7] ..... F02M 37/04

(52) U.S. Cl. ..... 123/509; 123/198 D; 137/563

(58) Field of Search ..... 123/509, 198 D, 123/514, 510, 497; 137/563, 565, 37, 510

(56) References Cited

U.S. PATENT DOCUMENTS

| | | | | | |
|---|---|---|---|---|---|
| 2,319,934 | A | * | 5/1943 | Korte et al. | 103/87 |
| 4,620,512 | A | * | 11/1986 | Brooks et al. | 123/145 A |
| 5,076,242 | A | * | 12/1991 | Parker | 123/514 |
| 5,164,879 | A | * | 11/1992 | Danowski et al. | 361/215 |
| 5,598,824 | A | * | 2/1997 | Treusch et al. | 123/470 |
| 5,785,032 | A | * | 7/1998 | Yamashita et al. | 123/509 |

FOREIGN PATENT DOCUMENTS

| | | | |
|---|---|---|---|
| DE | 195 30526 | * | 2/1997 |
| EP | 0754 852 | * | 1/1997 |

* cited by examiner

*Primary Examiner*—Carl S. Miller
(74) *Attorney, Agent, or Firm*—Ronald E. Greigg

(57) ABSTRACT

The invention relates to a fuel supply system for an internal combustion engine, having a unit, such as a pressure regulator, mounted in electrically insulated fashion and including an electrically conductive housing, and the housing is connected via an electrical connection to a defined electrical potential. As a result, static charging of the unit, which could become dangerous, is precluded. The fuel supply system is intended in particular for pumping fuel to an internal combustion engine of a motor vehicle.

18 Claims, 10 Drawing Sheets

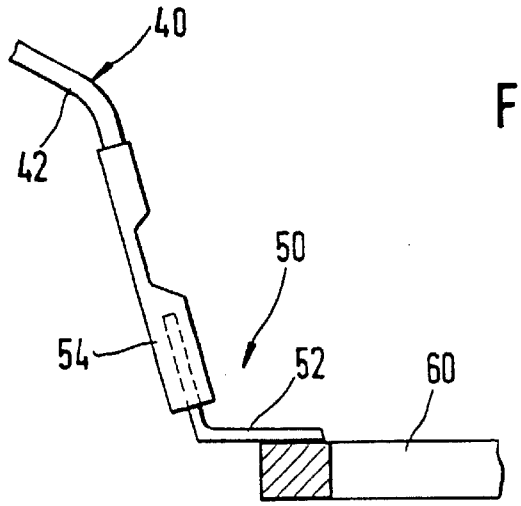
Fig.4a
Fig.4b
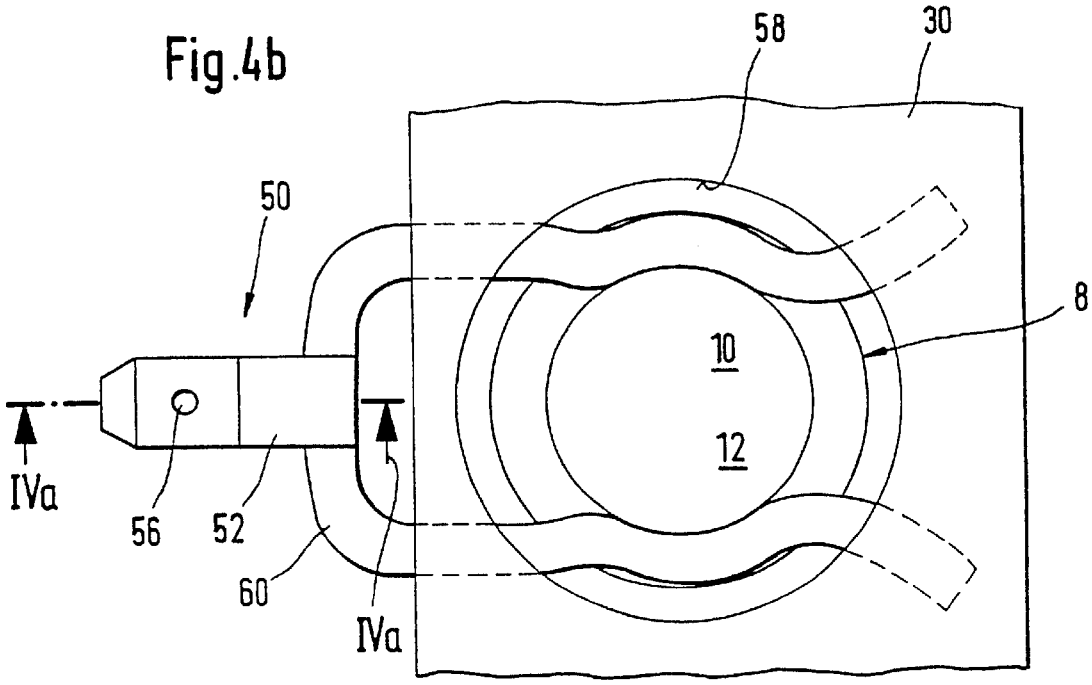

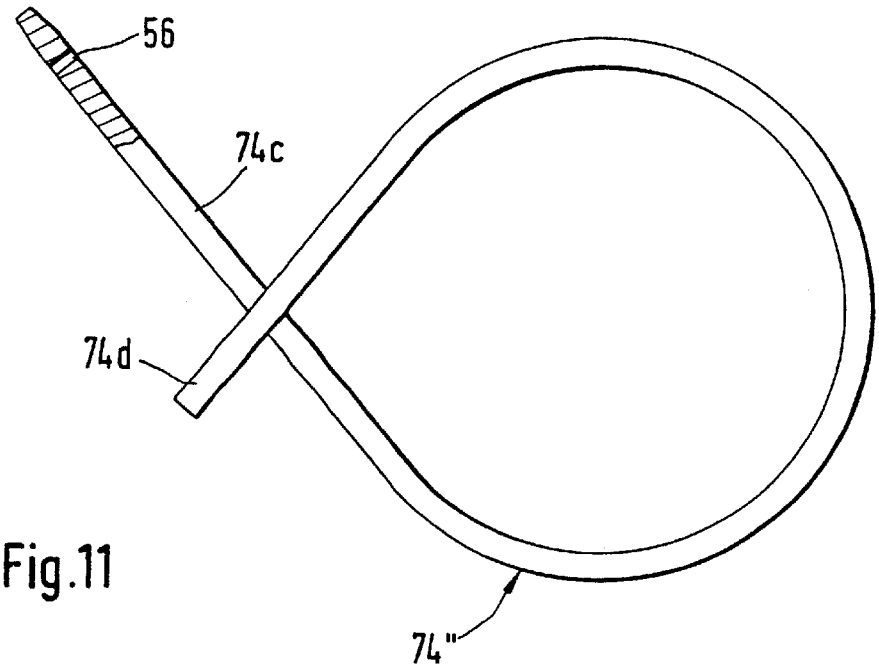
Fig.11
Fig.12a
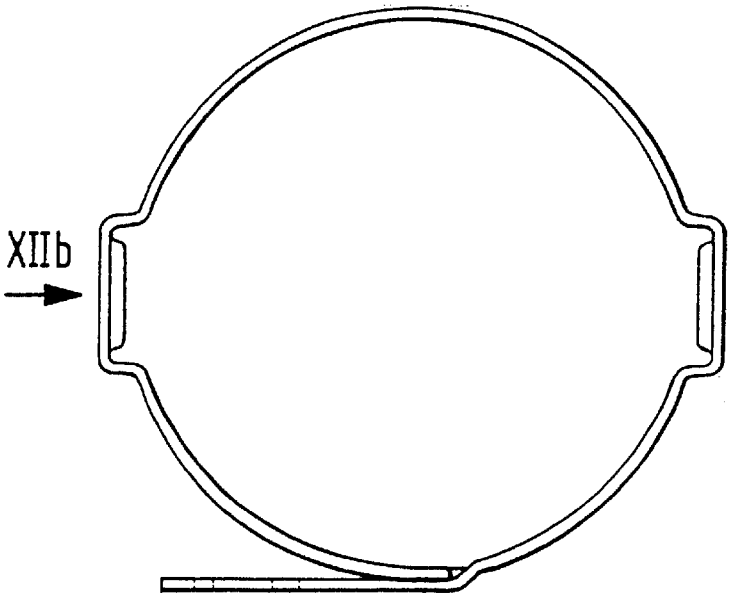
Fig.12b
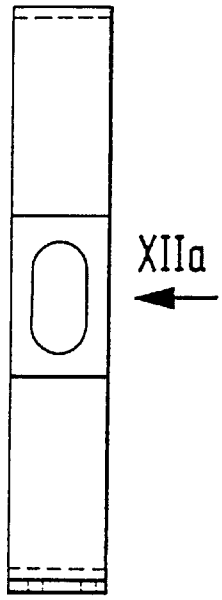

FUEL SUPPLY DEVICE

FIELD OF THE INVENTION

The invention is directed to improvements in a fuel supply system.

BACKGROUND OF THE INVENTION

A fuel supply system of an internal combustion engine, preferably in a motor vehicle, typically includes a plurality of units. In the fuel supply system, a fuel pump pumps fuel from a fuel reserve out of a fuel reserve container via various units, until the fuel finally reaches a combustion chamber of the engine. One of the units is for instance a pressure regulator, a fuel reservoir, a pressure damper, a fuel filter, or a fuel injection valve.

It can happen that one of the units, for instance the pressure regulator itself or a component of that unit is electrically conductive, yet the electrically conductive component or the unit is disposed in electrically insulated fashion, for instance because the unit is disposed on a base body that comprises non-conductive plastic.

German published, nonexamined patent application DE 44 02 224 A1 shows one such unit downstream of a fuel pump. Here, a pressure regulator is integrated with a body made of plastic. The pressure regulator has a housing part made of sheet metal. This housing part is an electrically conductive component, which has no electrical connection with an electrical conductor that forms a defined electrical potential.

In the unit having an electrically conductive component, electrostatic charging of the electrically conductive component can occur from electrical charge separation. Because typically the electrostatic charging of the electrically conductive component causes no problem and in particular no disruption in function, normally the electrostatic charging of the electrically conductive component is not noticed, or at least not taken into account. Because there are units through which the fuel flows through a narrow gap, for instance at a high flow velocity, as in a pressure regulator, the electrostatic charging of the electrically conductive component can be quite pronounced.

Sometimes, fortunately quite rarely, it could happen that a fire or explosion whose cause cannot be explained will occur in a fuel supply system. The inventors of the present patent application are of the opinion that at least some of these unexplainable fires have been caused by electrostatic charging of an electrically conductive component of a unit in the fuel supply system.

OBJECT OF THE INVENTION

It is a principal object of the invention to provide a fuel supply system having over the prior art that electrostatic charging of the electrically conductive component is prevented, and any source of danger it might cause is eliminated.

Other objects of the invention will become apparent upon a review of the drawings in connection with the specification hereinafter.

BRIEF DESCRIPTION OF THE DRAWINGS

Preferably selected and especially advantageous exemplary embodiments of the invention are shown in simplified form in the drawings and described in further detail below.

FIG. 4*a* shows in side view a further variant embodiment of the terminal connection of FIG. 1;

FIG. 4*b* shows in top view a detail of a further variant embodiment of the terminal connection of FIG. 1;

FIG. 11 shows a side view of a further variant embodiment of the terminal connection;

FIG. 12*a* shows an end view of another variant terminal connection;

FIG. 12*b* shows a side view of the terminal connection of FIG. 12*a;*

DESCRIPTION OF THE PREFERRED EMBODIMENTS

The fuel supply system embodied according to the invention is used to deliver fuel to an internal combustion engine. As the engine, an Otto cycle engine can for instance be considered. The fuel is gasoline or diesel, for instance; because gasoline is especially readily flammable, it is proposed that the fuel supply system be embodied according to the invention at least whenever the fuel is gasoline.

Figure 1:
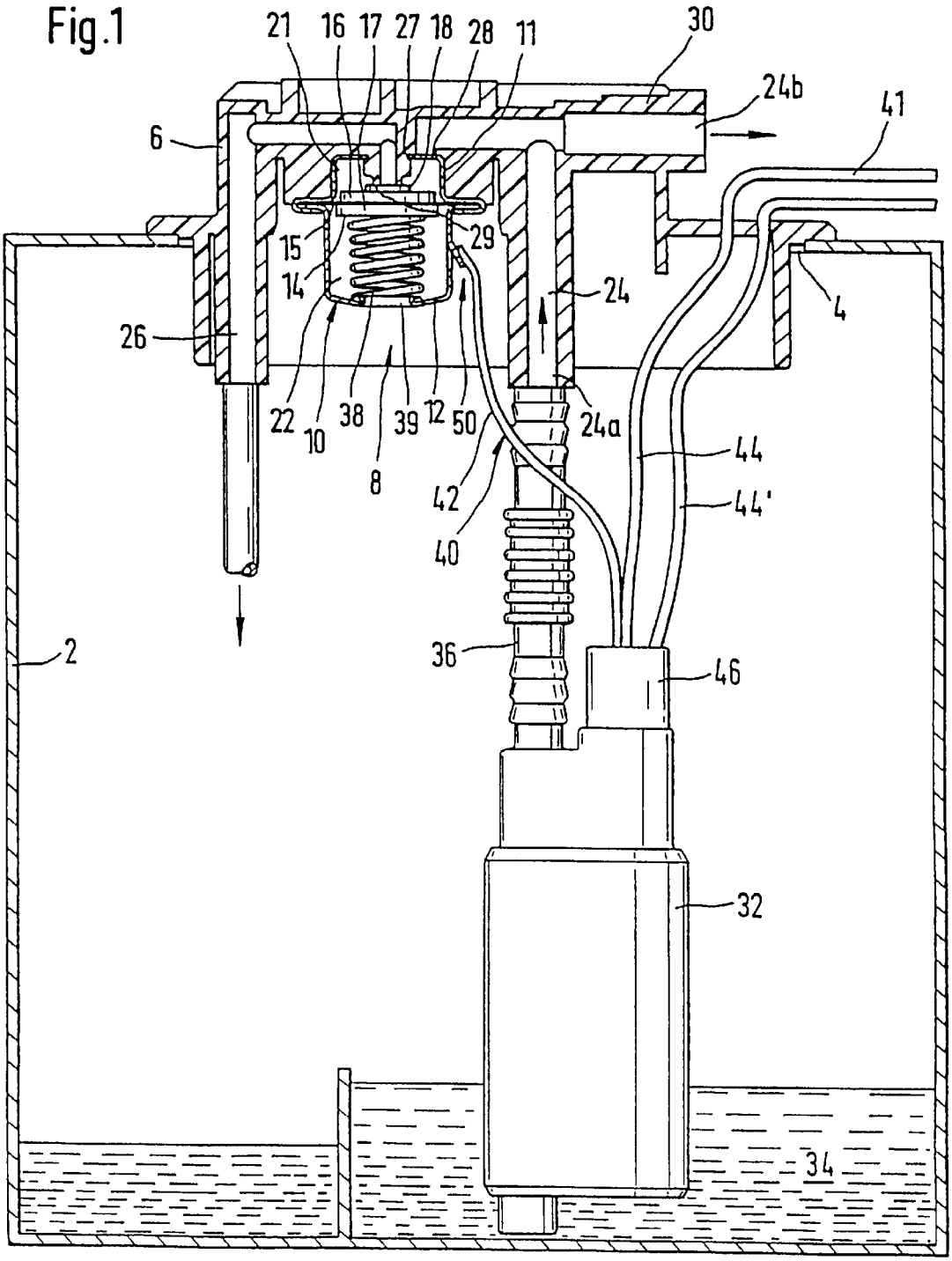
FIG. 1 shows a cross-sectional view of a fuel reserve container following the invention.

FIG. 1 shows a first preferably selected, advantageous exemplary embodiment.

FIG. 1 shows a fuel reserve container 2. The fuel reserve container 2 has an opening 4 in its upper wall. The opening 4 is closed with a plastic cap 6. The cap 6 is firmly screwed to the upper wall of the fuel reserve container 2 with the aid of screws, not shown. To enable manufacturing the cap 6 at reasonable expense despite its complicated shape, and for the sake of weight reduction, the cap 6 is of plastic. A pressure regulator 8 is functionally and in terms of form solidly integrated with the cap 6. The pressure regulator 8 has a housing 10. In the exemplary embodiment shown, the housing 10 comprises a first housing part 11 and a second housing part 12. In the housing 10, there is a diaphragm unit 14. In the exemplary embodiment shown, the diaphragm unit 14 includes a diaphragm 15, a first plate 16, a second plate 17, and a closing body 18. The plates 16 and 17 are solidly joined to the diaphragm 15 in the middle region of the diaphragm 15. On its outer circumference, the diaphragm 15 is entrapped between the first housing part 11 and the second housing part 12. The first plate 16 holds the closing body 18, which by way of example is a flattened ball.

The diaphragm 15 comprises one or more, preferably two, layers of flexible plastic plates.

The diaphragm 15 of the diaphragm unit 14 divides a first chamber 21 from a second chamber 22. The first chamber 21 is located essentially inside the first housing part 11, and the second chamber 22 is located essentially inside the second housing part 12. Inside the cap 6, there are a conduit 24 and a return conduit 26. In the exemplary embodiment shown, the conduit 24 has an inlet side 24*a* and a side 24*b* that extends onward. The first housing part 11, and its face end, has a bottom region with a central recess 27. Laterally offset, the bottom region of the housing part 11 has an opening 28. A neck protruding through the central recess 27 is formed onto the cap 6. A valve seat 29 is provided on a face end of the neck, oriented toward the closing body 18 of the diaphragm unit 14, of the plastic cap 6. The return conduit 26 extends through the cap 6 from the valve seat 29 into the fuel reserve container 2.

Because the cap 6 is not electrically conductive, the electrically conductive housing 10 of the pressure regulator 8 is electrically insulated from other conductive bodies that represent a defined electrical potential. It can also happen that the cap 6 comprises electrically conductive material but for instance because of an electrically nonconductive intermediate plate the cap 6 may be electrically insulated from other electrically conductive components of the motor vehicle. The result is an electrically insulating body (30), which in the exemplary embodiment shown has been created in the form of the cap 6.

A fuel pump 32 provided in the interior of the fuel reserve container 2 aspirates fuel from a fuel supply 34, located in the fuel reserve container 2, and feeds the fuel through a pressure line 36 into the conduit 24 via the inlet side 24*a*. Through the conduit 24, the fuel reaches the side 24*b* and is transported from there for instance to reach injection valves, not shown in FIG. 1. Through the conduit 24, the fuel also reaches the first chamber 21 through the opening 28. If the pressure in the first chamber 21 is less than a certain opening pressure, then the closing body 18 rests on the valve seat 29, and the first chamber 21 is closed off from the return conduit 26. If the pressure in the first chamber 21 exceeds the defined opening pressure, then the closing body 18 of the diaphragm unit 14 lifts from the valve seat 29, and excess fuel can return to the fuel reserve container 2, from the conduit 24, through the first chamber 21, through the gap between the valve seat 29 and the closing body 18, and then through the return conduit 26. A closing spring 38 urges the plate 17, and thus the closing body 18, against the valve seat 29. Instead of the closing spring 38, or in addition to the closing spring 38, a pressure prevailing in the second chamber 22 can serve to generate the closing force that urges the closing body 18 against the valve seat 29. In the exemplary embodiment shown, the housing part 12 has an opening 39 on its face end, for the sake of pressure equalization.

When the fuel flows through the plastic cap 6 or electrically insulating body 30, this can lead to a charge separation and thus to electrostatic charging, for instance of the housing 10. The risk of a charge separation and thus of the electrostatic charging is increased because the fuel flows through the narrow gap between the valve seat 29 and the valve body 18 out of the first chamber 21 into the return conduit 26 at high flow velocity. When the electrostatic charging of the housing 10 has reached a critical value, such as several thousand volts, then it can happen that an electrical sparkover will occur, in which the electrostatic charge is partly or entirely dissipated. Because the housing 10 is of metal and thus is an electrically highly conductive component, the charge build up over the entire housing 10 discharges with concentration at one point and in the briefest possible time because the charge of the entire housing 10 flows to the point of the sparkover. Thus the risk cannot be precluded that the electrical sparkover will reach a magnitude that leads to ignition of a fuel-air mixture. It cannot always be entirely be avoided that there will be an ignitable mixture inside or outside the fuel reserve container 2 in the region of the fuel supply system.

In order to avoid the dangerous electrostatic charging of the intrinsically electrically insulated housing 10, it is proposed that the housing 10 be connected to a defined electrical potential 41 via an electrical connection 40. In the selected exemplary embodiment, the electrical conductor 44, for instance, represents the defined electrical potential 41.

The electrical conductor 44 is used for supplying current to the fuel pump 32. The fuel pump 32 is connected to a current supply means, not shown, via the electrical conductor 44 and a second electrical conductor 44'. The electrical conductor 44 is a negative pole, for instance, and the second electrical conductor 44 is a positive pole, for instance. The electrical conductor 44 and thus the negative pole is connected for instance to the electrical ground of the vehicle in which the fuel supply system is for instance installed. It is also possible for the electrical conductor 44 to be the positive pole and the second electrical conductor 44' to be the negative pole. As needed, either the positive or the negative pole can be connected to the ground of the motor vehicle. To dissipate the electrostatic charge of the electrically conductive housing 10, the housing can be connected in principle to either the negative pole 44 or the positive pole 44'; for dissipating the electrostatic charge, it is not essential whether the electrical conductor 44 or the second electrical conductor 44' is connected to the electrical ground of the motor vehicle. However, it is proposed that the housing 10 via the electrical connection 40 be preferably connected to the electrical conductor 44 forming the negative pole; typically, the negative pole is connected to the electrical ground of the motor vehicle, so that the electrical ground of the motor vehicle represents the defined electrical potential 41 to which the metal housing 10 is connected.

The electrical connection 40 by way of example includes a simple, relatively thin, insulated braid or flexible, thin metal wire 42 coated with insulating material. The electrical conductors 44 and 44' discharge into a connector 46, which is inserted into a counterpart connector provided on the housing of the fuel pump 32. Inside the connector 46, the wire 42 of the electrical connection 40 is electrically connected to the electrical conductor 44. The introduction of the wire 42 of the electrical connection 40 into the connector 46 alongside the conductors 44, 44' is easily possible at no significant additional effort or expense. The two electrical conductors 44, 44' can also be replaced by a two-stranded cable for instance.

The electrical connection 40 is connected to the housing 10 at a terminal point via a terminal connection 50. The terminal connection 50 can be made for instance by soldering or welding a stripped end of the wire 42 of the electrical connection 40 to the housing 10, or to a tab protruding from the housing 10. To make it easier to assemble the fuel supply system, it is proposed that the terminal connection 50 be embodied such that the electrical connection 40 can be plugged into the housing 10 of the pressure regulator 8. The following drawing figures show details of variously embodied terminal connections 50.

Figure 2:
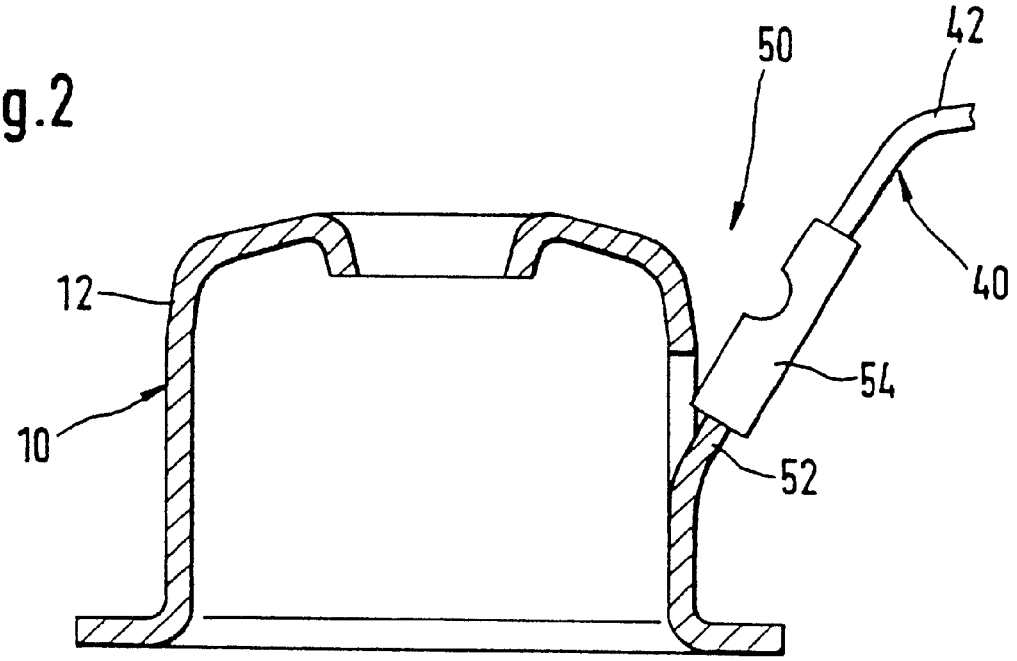
FIG. 2 shows a detail of a terminal connection shown in FIG. 1.

FIG. 2 by way of example shows the region of the terminal connection 50 as a detail.

In all the figures, identical or identically functioning elements are provided with the same reference numerals. Unless otherwise noted in the description or shown in the drawing, what is shown and described for one of the drawing figures applied to the other exemplary embodiments as well. Unless otherwise indicated by the explanation, the details of the various exemplary embodiments can be combined with one another.

FIG. 2 shows the second housing part 12 of the housing 10 of the pressure regulator 8. The housing part 12 comprises shaped sheet metal. A tab 52 is formed onto the housing part 12 by being stamped out. On the end of the wire 42 toward the housing 10, a connector 54 is provided. The connector 54 has a shape of a conventional kind for a simply designed plug in automotive engineering. The tab 52 is shaped such that the connector 54 can be slipped directly onto the tab 52. The tab 52 is located in the region of the cylindrical jacket face of the housing part 12 of the housing 10.

Figure 3:
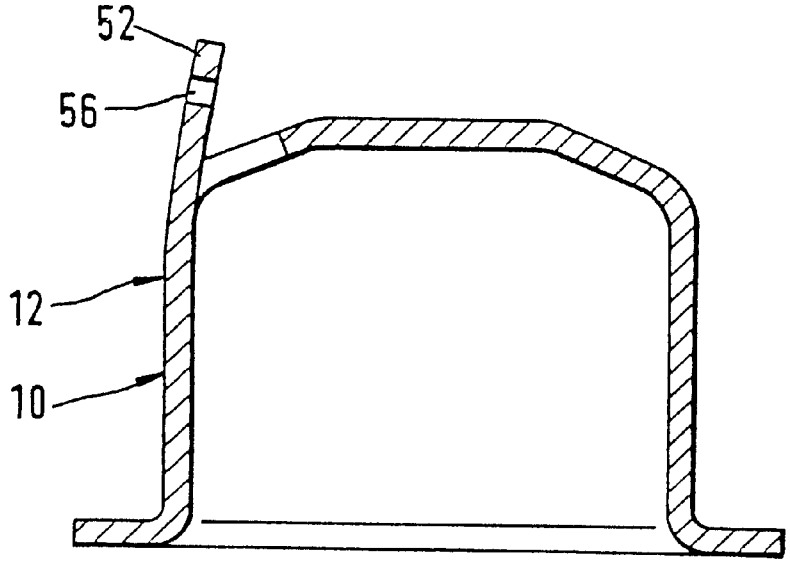
FIG. 3 shows a variant embodiment of the terminal connection of FIG. 1.

FIG. 3 shows an exemplary embodiment in which the tab 52 is formed in the region of the face end of the housing part (12) of the housing (10). As FIG. 3 shows, an aperture 56 is provided in the tab 52. The hole 56 corresponds with a protrusion provided in the connector 54, so that the connector 54 is reliably prevented from slipping off the housing 10.

FIGS. 4*a* and 4*b* as examples show a modified terminal connection 50 between the electrical connection 40 and the housing 10 of electrically conductive material.

FIG. 4*b* shows a portion of the electrically insulating body 30. There is an indentation, shown on the face end, in the electrically insulating body 30. The pressure regulator 8 is installed in this indentation 58.

There is also a slit in the electrically insulating body 30, into which a clamp 60 that firmly holds the pressure regulator 8 on the insulating body 30 is inserted. The clamp 60 is of spring steel, hence an electrically conductive material, and it has two legs and a curved region joining the two legs. In the exemplary embodiment shown in FIGS. 4*a* and 4*b*, the tab 52 comprises a simple sheet-metal strip. The tab 52 is welded or soldered onto the clamp 60 in the curved region of the clamp 60. FIG. 4*b* shows the tab 52 before the connector 54 is slipped onto it, and FIG. 4*a* shows a sectional view, marked IVa in FIG. 4*b*, after the connector 54 has been slipped onto the tab 52. The wire 42 is in electrical contact with the housing 10, via the clamp 60.

Figure 5A:
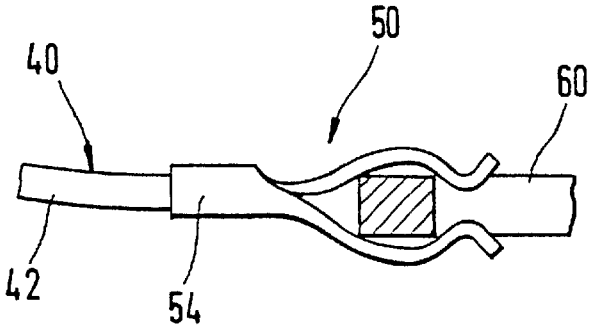
FIG. 5*a* shows in a side view a further variant embodiment of the terminal connection.
Figure 5B:
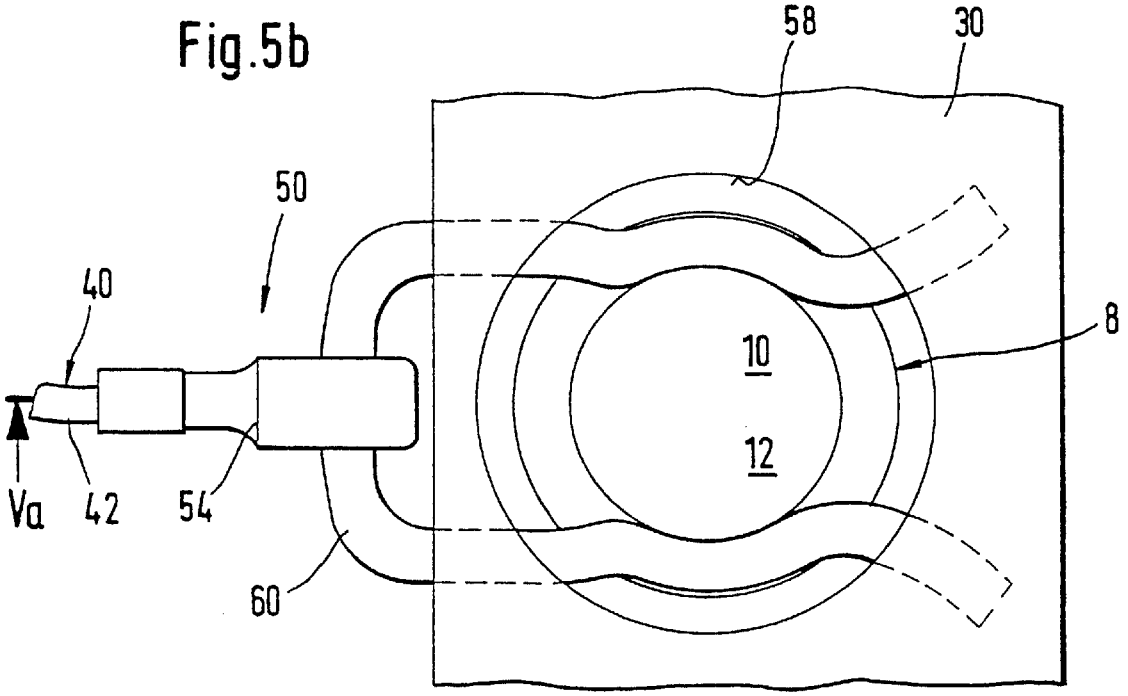
FIG. 5*b* shows in a top view the further variant embodiment of the terminal connection shown in FIG. 5*a;*

FIGS. 5*a* and 5*b* show a further selected, especially advantageous exemplary embodiment.

The exemplary embodiment shown in FIGS. 5*a* and 5*b* is largely equivalent to the exemplary embodiment shown in FIGS. 4*a* and 4*b*, except that in the exemplary embodiments shown in FIGS. 5*a* and 5*b*, the tab 52 on the clamp 60 can be omitted. In the exemplary embodiment of FIGS. 5*a* and 5*b*, the connector 54 is designed such that it resiliently embraces the clamp 60. The connector 54 has a first leg and a second leg. The legs of the connector 54 are designed such that they can be slipped over the curve between the two legs of the clamp 60. Between the two legs of the connector 54, the clamp 60 is fastened in place resiliently. Thus without any change in the region of the pressure regulator 8 or the clamp 60, it is possible to attach the electrical connection 40 in plug-in fashion.

Figure 6:
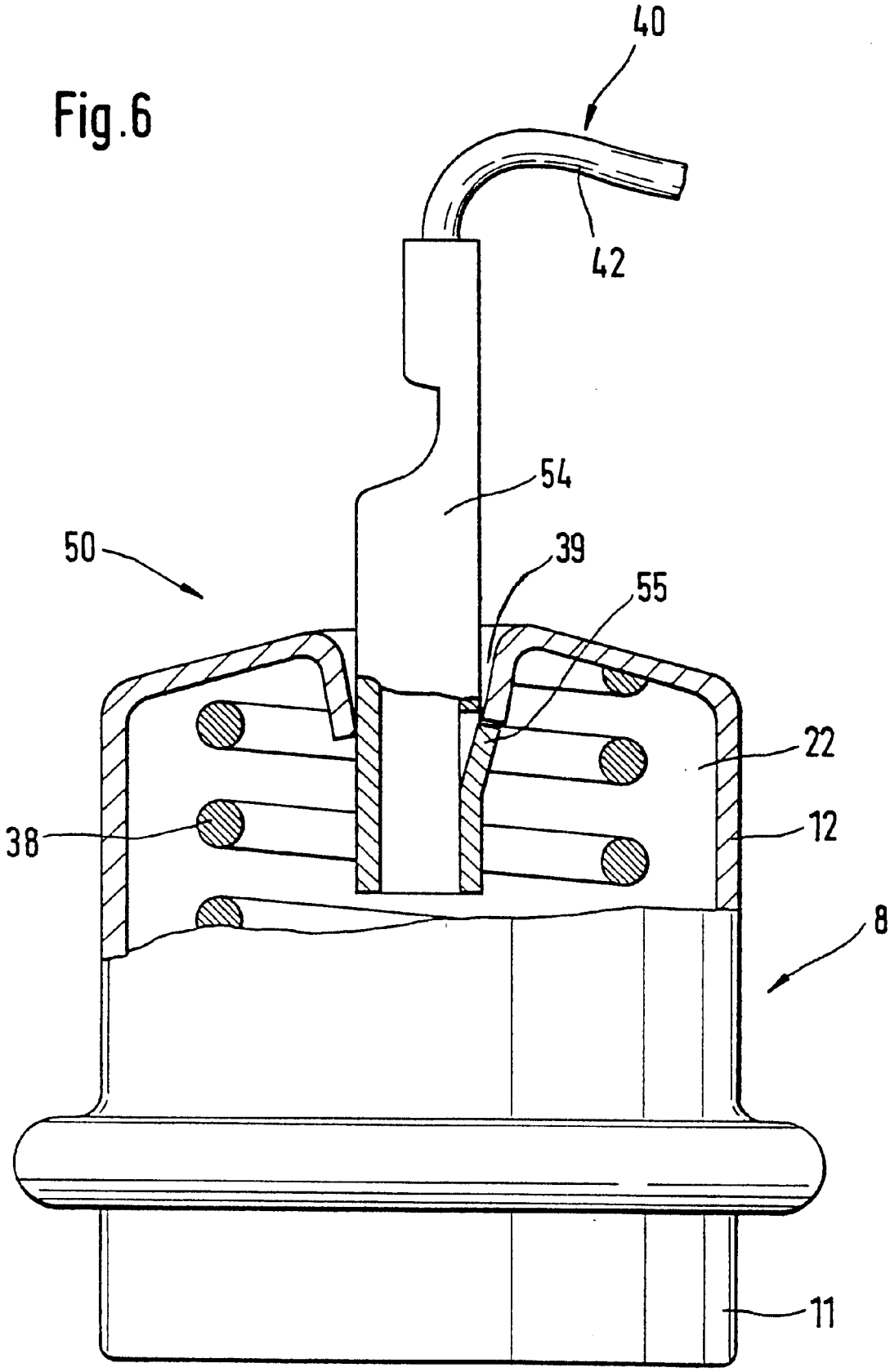
FIG. 6 shows a sectional view of a further variant embodiment of the terminal connection.

FIG. 6 shows a further selected, especially advantageous exemplary embodiment.

In the exemplary embodiment shown in FIG. 6, the opening 39 has been created by bending over the sheet metal, from which the housing part 12 is made, inward into the chamber 22. The connector 54 is inserted with a press fit into the opening 39. Bending over the sheet metal of the second housing part 12 creates a shape in the opening 39 that acts like a barb, so that it is easily possible to plug the connector 54 into the opening 39, yet the connector 54 is prevented from slipping out of the opening 39. The connector 54 can also be prevented from slipping out additionally by means of a radially outward-yielding tab 55, which is provided on the connector 54 and yields inward into the opening 39 while the connector 54 is being plugged in, and thereafter resumes its outset position and thus creates a positive, secure connection.

Figure 7:
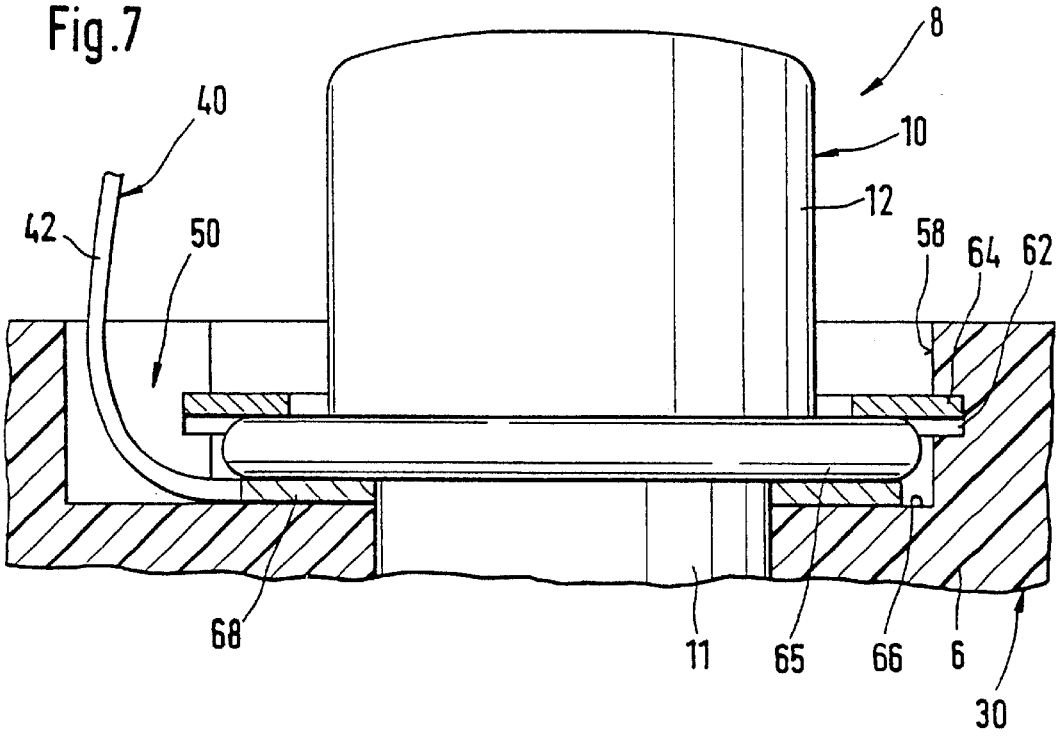
FIG. 7 shows a partial sectional view of yet a further embodiment of a terminal connection.

FIG. 7 shows a further selected, especially advantageous exemplary embodiment.

In the exemplary embodiment shown in FIG. 7, an encompassing plunge-cut groove 62 is provided in the indentation 58. A snap ring 64 is inserted into the plunge-cut groove 62. The snap ring 64 keeps a radially protruding, encompassing bead, created by crimping the two housing parts 11, 12 on the housing 10, against a shoulder 66 of the indentation 58 in the electrically insulating body 30. Between the bead 65 and the shoulder 66, an axially yielding ring 68 is arranged. Before installation, the ring 68 is approximately in the shape of a conical cup spring. The installation space between the snap ring 64 and the shoulder 66 is dimensioned such that after installation, the yielding ring 68 is pressed somewhat flat. As a result, it is attained in a simple manner that the pressure regulator 8 is installed in the body 30 without wobbling, and the result is a good electrical connection between the housing 10 and the resilient ring 68. The end of the wire 42 oriented toward the pressure regulator 8 is joined to the ring 68, for instance by soldering or by spot welding. In the exemplary embodiment shown in FIG. 7, the electrical connection 40 can be connected to the pressure regulator 8 without modification of the pressure regulator 8.

Figure 8:
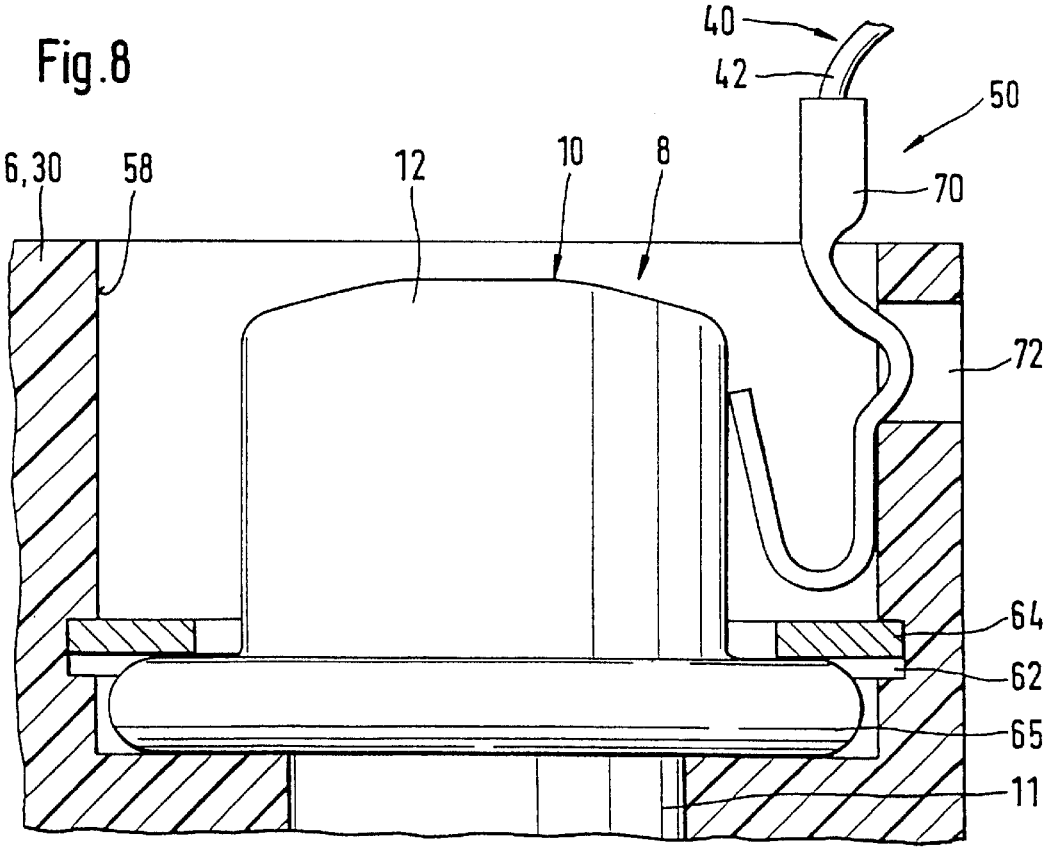
FIG. 8 shows a partial sectional view of still a further embodiment of a terminal connection.

FIG. 8 shows a further selected, especially advantageous exemplary embodiment.

In the exemplary embodiment shown in FIG. 8, a clamping spring 70 is mounted on the end of the wire 42 toward the pressure regulator 8. The clamping spring 70 has one end in which the wire 42 is clamped. The wire 42 is clamped in place on this end in the usual way for plugs in automotive engineering. The clamping spring 70, made from electrically conductive, resilient flat material, is shaped in hook-like fashion, and it is clamped in place between the wall of the indentation 58 of the body 30 and the cylindrical portion of the housing part 12. An aperture 72 is provided in the wall of the indentation 58. The clamping spring 70 has a convex bulge that protrudes into the aperture 72. The result, when the clamping spring 70 is plugged into the surrounding interstice between the housing 10 and the body 30 is an interlocking action that assures that the clamping spring 70 cannot slip out. This assures a secure electrical connection between the electrical connection 40 and the pressure regulator 8, without having to make any modification to the pressure regulator 8 on account of the electrical connection 40.

Figure 9:
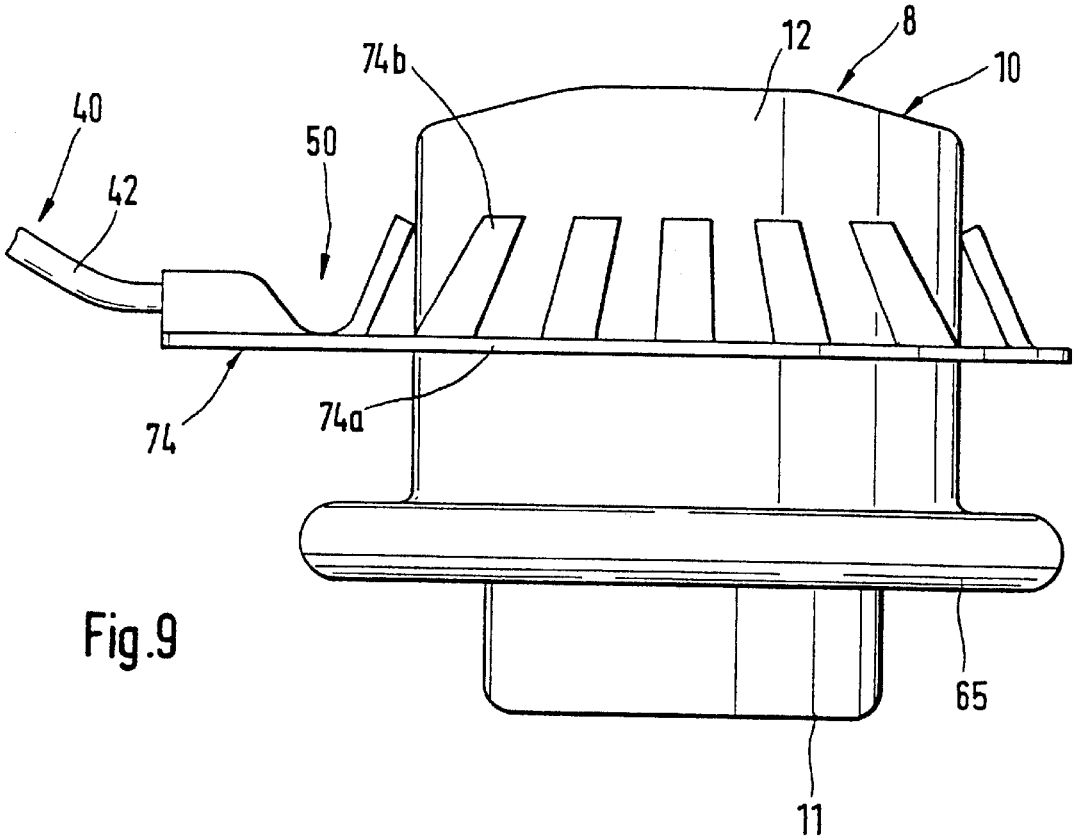
FIG. 9 shows a side view of yet another embodiment of a terminal connection.

FIG. 9 shows a further selected, especially advantageous exemplary embodiment.

In comparison with FIG. 8, in the exemplary embodiment shown in FIG. 9 the clamping spring 70 has been replaced with a clamping spring 74. The clamping spring 74 can be connected to the wire 42 of the electrical connection 40 in the same way as the clamping spring 70. The clamping spring 74 is stamped out of a thin resilient sheet-metal plate.

The clamping spring 74 has one region that forms a ring 74*a*. Tabs 74*b* are formed onto the ring 74. Before the clamping spring 74 is slipped onto the housing part 12, the tabs 74*b* protrude radially inward. The tabs 74*b* protrude so far inward that after the clamping spring 74 has been slipped onto the housing part 12, the tabs are bent over by approximately 10 degrees to 80 degrees. As a result, the clamping spring 74 is interlocked with the housing 10, so that it is easy to slip the clamping spring 74 on, yet unintended slipping of the clamping spring 74 off the housing part 12 is reliably avoided.

Figure 10:
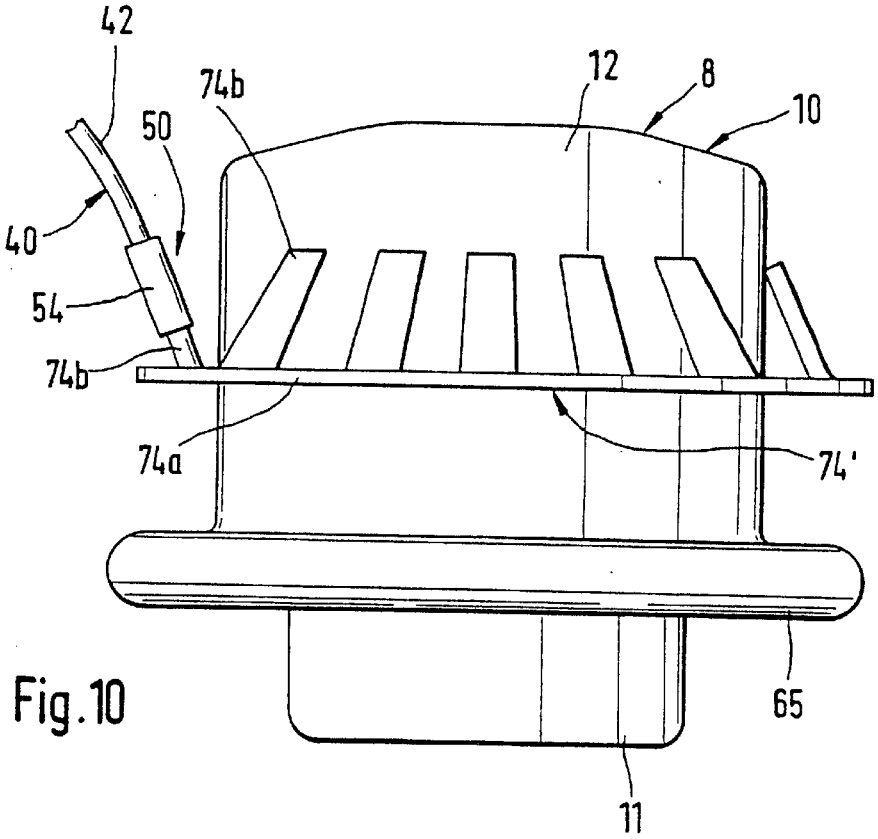
FIG. 10 shows in side view a variant embodiment of the terminal connection shown in FIG. 9.

FIG. 10 shows a further advantageous exemplary embodiment.

FIG. 10 shows an exemplary embodiment having clamping spring 74'; the clamping spring 74' (FIG. 10) is designed essentially identically to the clamping spring 74 (FIG. 9). The tabs 74*b* of the clamping spring 74' are approximately wide and thick enough that they fit the connector 54 mounted on the wire 42. One of the tabs 74*b* of the clamping spring 74' is bent outward somewhat more markedly, and the connector 54 is slipped onto this more markedly outward-bent tab 74*b*.

FIG. 11 shows a further advantageous exemplary embodiment.

Here, the connection of the electrical connection 40 (FIG. 1) is effected via a clamping spring 74". The clamping spring 74" is bent out of resilient flat material and essentially forms a circle, with an inside diameter that in the relaxed state is smaller than the outside diameter of the housing part 12. The clamping spring 74" is wound helically with only slight pitch and has two legs 74*c* and 74*d*. By pressing on the two legs 74*c*, 74*d*, the inside diameter of the clamping spring 74" can be increased elastically, so that the clamping spring 74" can be fitted over the cylindrical part of the housing part 12. After the two legs 74*c*, 74*d* are released, the clamping spring 74" resiliently contracts radially inward and becomes clamped to the cylindrical region of the housing part 12.

The leg 74*c* is shaped such that it can be put together with the connector 54 (FIG. 10).

FIG. 12 shows a further advantageous exemplary embodiment.

In this exemplary embodiment, the connection of the electrical connection 40 is made via a pipe clamp mounted on the housing 10. The pipe clamp comprises flat material, and one end of this flat material is shaped such that this end can be put together with the connector 54 (FIG. 10). The pipe clamp can easily be secured to the housing part 12 of the pressure regulator 8.

Figure 13:
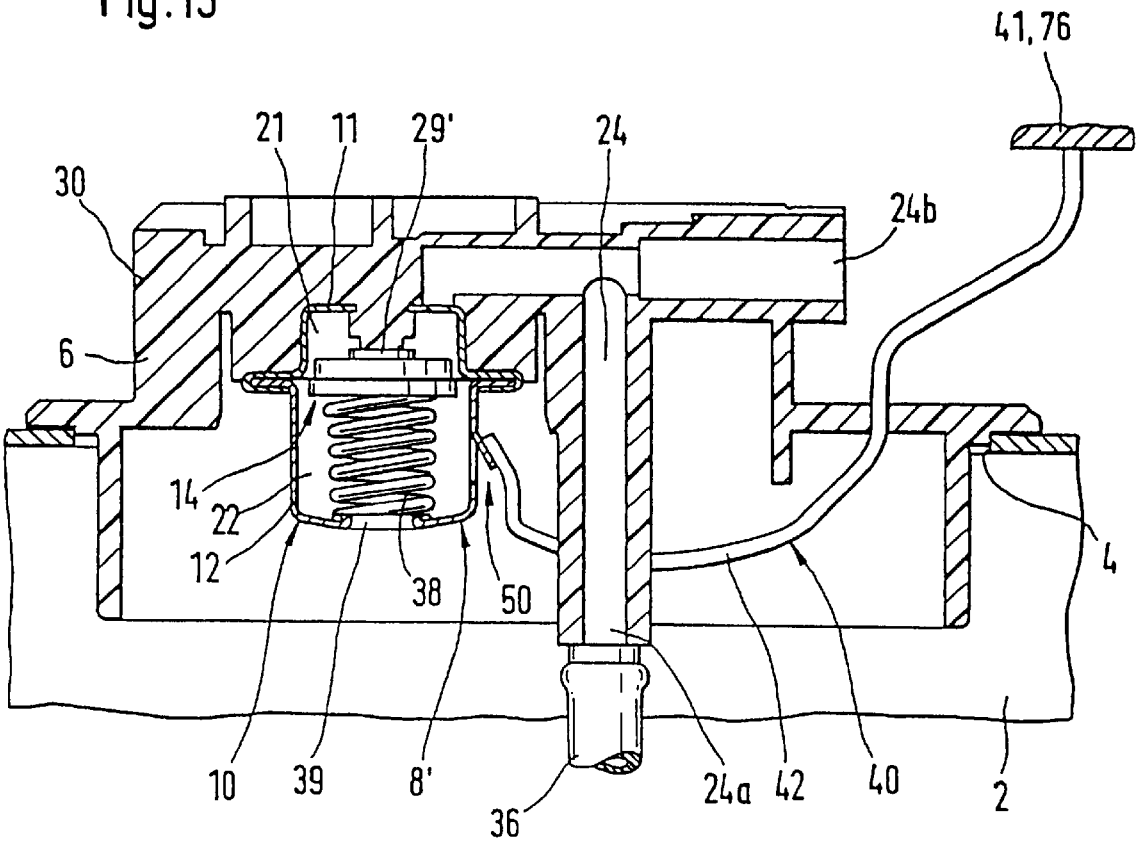
FIG. 13 shows a detail in cross-section of yet another form of terminal connection.

FIG. 13 shows a further preferentially selected, advantageous exemplary embodiment.

In the exemplary embodiment shown in FIG. 1, the unit including the electrically conductive component forms the pressure regulator 8. In the exemplary embodiment shown in FIG. 13, the electrically insulating body 30, the housing 10, the diaphragm unit 14, and a stop 29' provided on the body 30 are the essential parts of a reservoir 8'. Depending upon whether the reservoir 8', upon pressure changes in a conduit 24, takes up or dispenses a relatively large or relatively small amount of fuel, the reservoir 8' serves only to smooth out pronounced pressure pulsations in the conduit 24, or the reservoir 8' in the event of pressure elevation can hold larger quantities of fuel that it then dispenses again when the pressure drops, so that the reservoir 8' can effectively function like a fuel reservoir. In the exemplary embodiment shown in FIG. 13, the valve seat 29 (FIG. 1) is omitted. Instead, the diaphragm unit 14 comes to rest on the stop 29' provided on the body 30, and the return conduit 26 shown in FIG. 1 is omitted.

In the exemplary embodiment shown in FIG. 13, the electrical connection 40 is connected directly to the electrical ground 76, for instance by being connected to the motor vehicle body. Here the electrical ground 76 of the motor vehicle forms the defined electrical potential 41, to which the electrically conductive housing 10 of the reservoir 8' is connected. It is understood that the reservoir 8' shown in FIG. 13 can, like the pressure regulator 8 shown in FIG. 1, be connected to the conductor 44 or 44' (FIG. 1) leading to the fuel pump 32.

Figure 14:
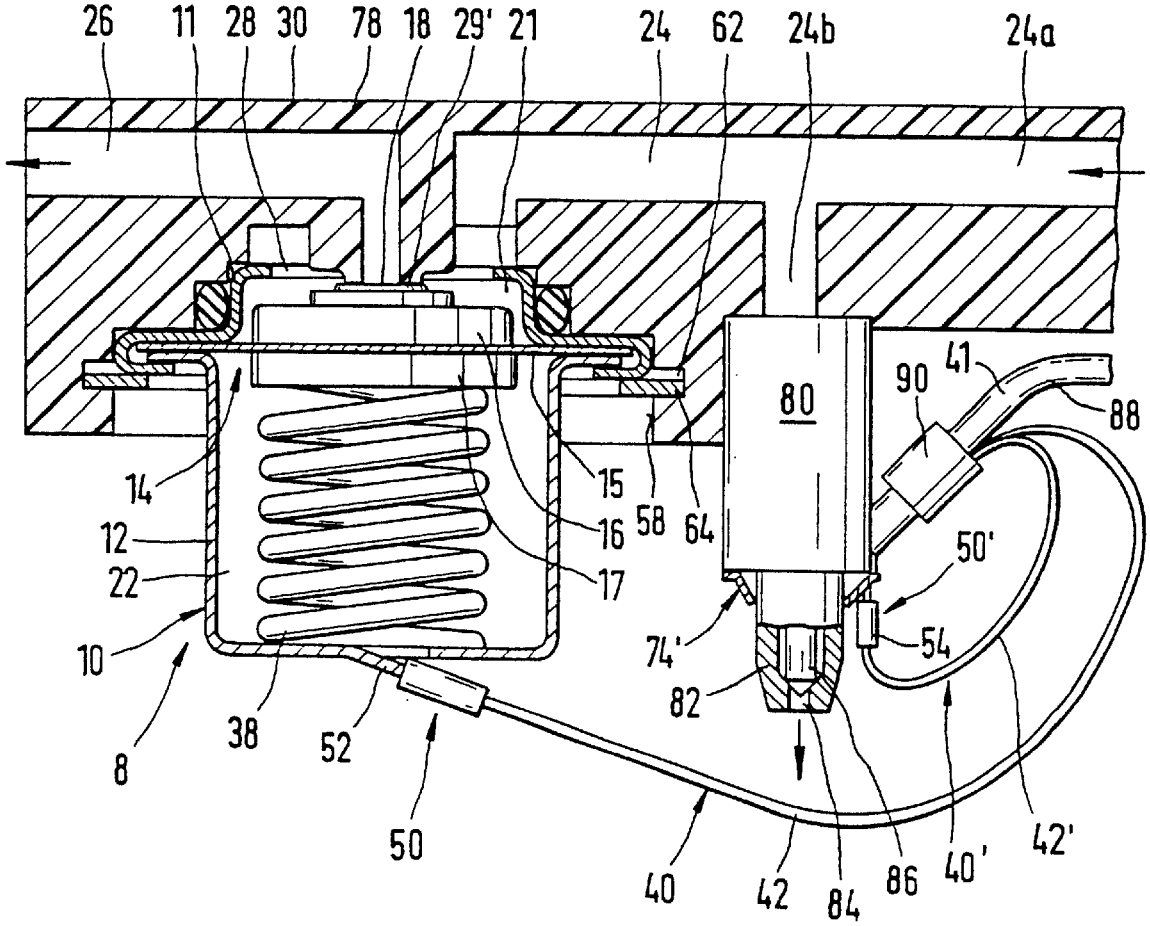
FIG. 14 shows a cross-sectional view of yet another form of terminal connection.

FIG. 14 shows a further selected and especially advantageous exemplary embodiment.

In this exemplary embodiment, the pressure regulator 8 is not located on the cap 6 (FIG. 1); instead, the pressure regulator 8 is mounted on a fuel distributor pipe 78 that is made of plastic. On the outlet side 24*b* of the conduit 24, which in this exemplary embodiment leads through the fuel distributor pipe 78, an injection valve 80 is connected. Depending upon the number of cylinders of the engine, the fuel distributor pipe 78 has a plurality of outlet sides 24*b* branching off from the conduit 24, with one injection valve connected to each of them, but for the sake of simplicity only one of the injection valves 80 is shown. All the injection valves may be embodied identically and connected identically.

The injection valve 80 has a housing part 82 of conductive material, preferably metal. In the housing part 82, there is a bore 84, through which, under the control of a valve body 86, fuel can flow out at high flow velocity from the conduit 24 of the fuel distributor pipe 78 into an intake tube of the engine, made for instance of plastic and not shown.

In this exemplary embodiment, the fuel distributor pipe 78 of plastic forms the electrically insulating body 30. Even via the intake tube, an electrostatic charge of the injection valve 80 cannot be prevented, if as is frequently the case the intake tube is of electrically non-conductive material, such as plastic.

Because of the high flow velocity of the fuel between the housing part 82 and the valve body 86, a charge separation can occur, which can lead to an electrostatic charging of the housing part 82, if the housing part 82 is not connected to a defined electrical potential. To prevent the electrostatic charging of the housing part 82, the housing part 82 is connected to the defined electrical potential 41 via an electrical connection 40'. The wire 42' of the electrical connection 40' is connected for instance to a wire of a cable 88, by way of which the injection valve 80 is electrically connected to a control unit, not shown. In this exemplary embodiment, one of the wires in the cable forms the defined electrical potential 41. The wire 42 of the electrical connection 40 can also be connected to the same electrically conductive wire of the cable 88 to which the wire 42 of the electrical connection 40' is connected. In principle, it does not matter which of the wires in the cable 88 is used for the defined electrical potential 41. The cable 88 is connected to the injection valve 80 via a connector 90. It requires no significant additional expense, together with the cable 88, also to connect the wires 42 and 42' to the connector 90. The advantage is additionally obtained thereby that for the wires 42 and 42', a short structural length suffices, since the connector 90 is located in the region of the components that have to be protected against electrostatic charging.

The wire 42' of the electrical connection 40' is connected to the electrically conductive housing part 82 of the injection valve 80 via a terminal connection 50'. The terminal connection 50' can be embodied the same as has been shown for the terminal connection 50 in various other drawing figures.

The pressure regulator 8 (FIGS. 1, 14), the reservoir 8' (FIG. 13), the injection valve 80 (FIG. 14), and optionally other components of the fuel supply system, such as a fuel filter, are units of the fuel supply system that have one or more electrically conductive components, such as the housing parts 11, 12 (FIGS. 1, 13, 14) or the housing part 82 (FIG. 14), which because of the electrically insulating body 30, such as the cap 6 (FIGS. 1, 13), the fuel distributor pipe 78 (FIG. 14), or some other electrically insulating body made of nonconductive material, are electrically insulated from an electrical conductor that could represent the defined electrical potential 41. The pressure regulator 8 and the reservoir 8' are hydraulically functioning units, which intrinsically require no electrical connection. The electrical connection 40 serves only to connect the component, made of electrically conductive material, of the pressure regulator 8 or reservoir 8' with the defined electrical potential 41.

In order to connect the electrically conductive component of the pressure regulator 8 or reservoir 8' or injection valve 80 with the defined electrical potential 41, it is possible for instance to realize the electrical connection 40 by adding special substances to the electrically insulating body 30 that make the body 30 electrically conductive. It is also possible to coat only the surface of the body 30 either entirely or in part with electrically conductive material, in such a way that the electrical connection 40 between the electrically conductive housing 10 or the electrically conductive housing part 82 and an electrical conductor that represents the defined electrical potential 41 are produced by means of the electrically conductive surface on the insulating body 30.

The foregoing relates to preferred exemplary embodiments of the invention, it being understood that other variants and embodiments thereof are possible within the spirit and scope of the invention, the latter being defined by the appended claims.

What is claimed is:

1. A fuel supply system, having a fuel pump that pumps fuel from a fuel reserve via a unit (8, 8', 80), in which the unit (8, 8', 80) includes at least one electrically conductive housing part (10, 11, 12, 82) retained so as to be electrically insulated from an electrical potential of an electrical conductor, and the electrically conductive housing part (10, 11, 12, 82) is connected via an electrical connection (40, 40', 42, 42') to the electrical potential (41) of the electrical conductor (44, 44', 76, 78), and a tab (52) is formed onto the housing part (10, 11, 12, 82) by stamping, and the electrical connection (40, 40', 42, 42') is connected to the tab (52) via a plug connection (54).

2. The fuel supply system according to claim 1, in which the electrical connection (40, 40', 42, 42') has a connector (54) slipped onto the tab (52).

3. The fuel supply system according to claim 2, in which the connector (54) has a protrusion, and the tab (52) has an aperture (56) cooperating with the protrusion of the connector (54).

4. The fuel supply system according to claim 1, in which the housing part (10, 11, 12) is a component of a pressure regulator (8).

5. The fuel supply system according to claim 1, in which the housing part (10, 11, 12) is a component of a reservoir (8').

6. The fuel supply system according to claim 1, in which the housing part (10, 11, 12) is a component of an injection valve (80).

7. A fuel supply system, having a fuel pump that pumps fuel from a fuel reserve via a unit (8, 8', 80), in which the unit (8, 8', 80) includes at least one electrically conductive component (10, 11, 12, 82) retained so as to be electrically insulated from an electrical potential of an electrical conductor, and the electrically conductive component (10, 11, 12, 82) is connected via an electrical connection (40, 40', 42, 42') to the electrical potential (41) of the electrical conductor (44, 44', 76, 78), and wherein the unit is a pressure regulator (8).

8. The fuel supply system according to claim 7, in which the electrically conductive component (10, 11, 12, 82) forms a housing part (11, 12, 82) of the unit (8, 8', 80).

9. The fuel supply system according to claim 7, in which the fuel supply system is built into a motor vehicle body, and the body forms the electrical conductor (76) to which the electrically conductive component (10, 11, 12, 82) is connected via the electrical connection (40, 40').

10. The fuel supply system according to claim 8, in which the fuel supply system is built into a motor vehicle body, and the body forms the electrical conductor (76) to which the electrically conductive component (10, 11, 12, 82) is connected via the electrical connection (40, 40').

11. A fuel supply system, having a fuel pump that pumps fuel from a fuel reserve via a unit (8, 8', 80), in which the unit (8, 8', 80) includes at least one electrically conductive component (10, 11, 12, 82) retained so as to be electrically insulated from an electrical potential of an electrical conductor, and the electrically conductive component (10, 11, 12, 82) is connected via an electrical connection (40, 40', 42, 42') to the electrical potential (41) of the electrical conductor (44, 44', 76, 78), wherein the unit (8, 8', 80) is disposed in a wall member (6), comprising nonconductive material, of a fuel reserve container (2) that receives the fuel reserve (34).

12. The fuel supply system according to claim 11, in which the wall member (6) is a plastic cap (6) of the fuel reserve container (2).

13. The fuel supply system according to claim 11, in which the fuel supply system is built into a motor vehicle body, and the body forms the electrical conductor (76) to which the electrically conductive component (10, 11, 12, 82) is connected via the electrical connection (40, 40').

14. The fuel supply system according to claim 12, in which the fuel supply system is built into a motor vehicle body, and the body forms the electrical conductor (76) to which the electrically conductive component (10, 11, 12, 82) is connected via the electrical connection (40, 40').

15. The fuel supply system according to claim 11, in which the electrically conductive component (10, 11, 12, 82) forms a housing part (11, 12, 82) of the unit (8, 8', 80).

16. A fuel supply system, having a fuel pump that pumps fuel from a fuel reserve via a unit (8, 8', 80), in which the unit (8, 8', 80) includes at least one electrically conductive component (10, 11, 12, 82) retained so as to be electrically insulated from an electrical potential of an electrical conductor, and the electrically conductive component (10, 11, 12, 82) is connected via an electrical connection (40, 40', 42, 42') to the electrical potential (41) of the electrical conductor (44, 44', 76, 78), wherein the fuel pump (32) has an electrical terminal (44, 44'), and the electrical terminal (44, 44') forms the electrical conductor (44, 44') to which the electrically conductive component (10, 11, 12, 82) is connected via the electrical connection (40, 40').

17. The fuel supply system according to claim 16, in which the fuel supply system is built into a motor vehicle body, and the body forms the electrical conductor (76) to which the electrically conductive component (10, 11, 12, 82) is connected via the electrical connection (40, 40').

18. The fuel supply system according to claim 16, in which the electrically conductive component (10, 11, 12, 82) forms a housing part (11, 12, 82) of the unit (8, 8', 80).

* * * * *